US009033256B2

(12) United States Patent
Imoehl

(10) Patent No.: US 9,033,256 B2
(45) Date of Patent: May 19, 2015

(54) CATALYTIC COATING TO PREVENT CARBON DEPOSITS ON GASOLINE DIRECT INJECTOR TIPS

(75) Inventor: William James Imoehl, Williamsburg, VA (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 704 days.

(21) Appl. No.: 13/221,586

(22) Filed: Aug. 30, 2011

(65) Prior Publication Data

US 2013/0048748 A1 Feb. 28, 2013

(51) Int. Cl.

| | |
|---|---|
| ***F02D 7/00*** | (2006.01) |
| ***F02M 61/18*** | (2006.01) |
| ***F02M 61/16*** | (2006.01) |
| ***F02M 51/06*** | (2006.01) |

(52) U.S. Cl.

CPC ..... *F02M 61/18* (2013.01); *F02M 61/166* (2013.01); *F02M 2200/06* (2013.01); *F02M 2200/9038* (2013.01); *F02M 51/0682* (2013.01); *F02M 51/0675* (2013.01); *F02M 2200/502* (2013.01); *Y10S 239/14* (2013.01)

(58) Field of Classification Search

CPC ..... F02M 61/168; F02M 2200/9038; F23R 3/28

USPC ..... 239/88–92, 533.2–533.12, 239/585.1–585.5, 5; 137/375

See application file for complete search history.

(56) References Cited

U.S. PATENT DOCUMENTS

| | | | | |
|---|---|---|---|---|
| 6,145,763 | A * | 11/2000 | Fleming et al. | 239/585.1 |
| 6,267,307 | B1 * | 7/2001 | Pontoppidan | 239/585.4 |
| 6,502,769 | B2 | 1/2003 | Imoehl | |
| 7,051,961 | B2 * | 5/2006 | Mills et al. | 239/585.4 |
| 2010/0126471 | A1 * | 5/2010 | Cheiky et al. | 123/476 |
| 2010/0180597 | A1 * | 7/2010 | Kraemer et al. | 60/723 |

FOREIGN PATENT DOCUMENTS

| | | | |
|---|---|---|---|
| EP | 2042582 | A2 | 4/2009 |
| WO | 0102719 | A1 | 1/2001 |

OTHER PUBLICATIONS

International Search Report and Written Opinion of the International Searching Authority, PCT/US2012/052643, Feb. 18, 2013.

* cited by examiner

*Primary Examiner* — Dinh Q Nguyen

(57) ABSTRACT

A fuel injector (10) has an inlet (12), an outlet (14), and a passageway (16) providing a fuel flow conduit from the inlet to the outlet. A valve structure (22, 24) is movable in the passageway between first and second positions. A seat (26) is provided at the outlet and has at least one seat passage (28) in communication with the passageway. Movement of the valve structure between the first and second positions controls the flow of fuel through the seat passages. The seat includes an outer tip surface (30) through which the least one seat passage extends. A catalytic coating (32) is provided on at least a portion of the outer tip surface. The coating causes oxidation of fuel on the coating to occur at a temperature lower than if the coating was not provided.

15 Claims, 1 Drawing Sheet

CATALYTIC COATING TO PREVENT CARBON DEPOSITS ON GASOLINE DIRECT INJECTOR TIPS

FIELD OF THE INVENTION

The invention relates to gasoline direct injection for vehicles and, more particularly, to providing a coating on a fuel injector tip to reduce deposits through oxidation.

BACKGROUND OF THE INVENTION

Carbon deposits on the tips of gasoline direct fuel injectors have been a problem since the introduction of the technology. The deposits result in flow reduction, spray variation, and increased particulate and hydrocarbon emissions. The problem has been partially resolved with careful configuration of the injector nozzles including hole inner diameter ratios, stepped holes, sac design, and coatings to reduce surface tension to discourage adhesion of the deposits, as disclosed, for example, in U.S. Pat. No. 6,502,769. The coatings have been for the most part ineffective. Flow and spray deviation has been mostly addressed with the mentioned configuration details.

The current trend toward centrally injected engines increases the problem, due to the higher injector tip temperatures encouraging deposit formation. There is still a lingering problem with injector tip surface deposits (not in the metering holes) that cause increased particle emissions. Particulate emissions are being strictly regulated beginning with Euro 6 and LEVIII legislation.

The current state of the art addresses flow deviation caused by deposits in the holes and not the deposits formed on the face of the injector tip. It has been determined that the deposits on the injector tip serve as a sort of sponge, storing fuel from the injection which later burns with a diffusion flame causing smoke and particulate emissions.

Thus, there is a need to keep the face of an injector tip free from deposits by ensuring that the fuel will oxidize on the tip surface before the deposits form.

SUMMARY OF THE INVENTION

An object of the invention is to fulfill the need referred to above. In accordance with the principles of the present invention, this objective is obtained by providing a fuel injector having an inlet, an outlet, and a passageway providing a fuel flow conduit from the inlet to the outlet. The fuel injector has a valve structure movable in the passageway between a first position and a second position. A seat is provided at the outlet and has at least one seat passage in communication with the passageway. The seat contiguously engages a portion of the valve structure in the first position thereby closing the at least one seat passage and preventing fuel from exiting the at least one passage. The valve structure, in the second position, is spaced from the at least one seat passage so that fuel can move through the passageway and exit through the at least one seat passage. The seat includes an outer tip surface through which the least one seat passage extends. A catalytic coating is provided on at least a portion of the outer tip surface. The coating is constructed and arranged to cause oxidation of fuel on the coating to occur at a temperature lower than if the coating was not provided.

In accordance with another aspect of a disclosed embodiment, a method promotes oxidation of fuel at an outer tip surface of a fuel injector. The method provides a fuel injector having an inlet; an outlet; a passageway providing a fuel flow conduit from the inlet to the outlet; a valve structure movable in the passageway between a first position and a second position; and a seat, at the outlet, having at least one seat passage in communication with the passageway. The seat contiguously engages a portion of the valve structure in the first position thereby closing the at least one seat passage and preventing fuel from exiting the at least one passage. The valve structure, in the second position, is spaced from the at least one seat passage so that fuel can move through the passageway and exit through the at least one seat passage. The seat includes an outer tip surface through which the least one seat passage extends. The method coats a catalyst on at least a portion of the outer tip surface. The catalytic coating is constructed and arranged to cause oxidation of fuel on the coating to occur at a temperature lower than if the coating was not provided.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
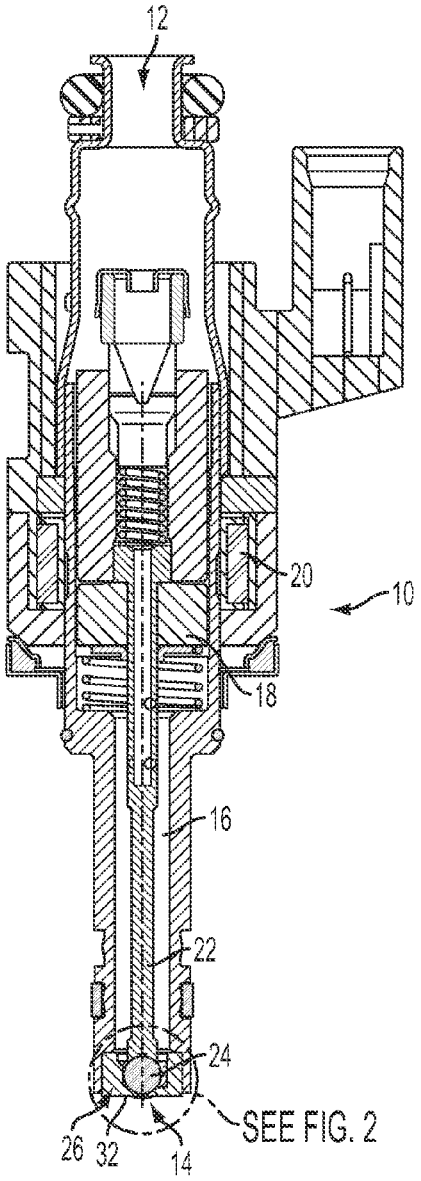
FIG. 1 is a view of gasoline direct fuel injector provided in accordance with an embodiment.

With reference to FIG. 1, a gasoline direct fuel injector is shown, generally indicated at 10, in accordance with an embodiment of the invention. The fuel injector 10 is of having a fuel inlet 12, a fuel outlet 14, and a fuel passageway 16 extending from the fuel inlet 12 to the fuel outlet 14. The injector 10 is of the conventional, solenoid-operated type, having an armature 18 operated by a coil 20. Electromagnetic force is generated by current flow from the electronic control unit (not shown) through the coil 20. Movement of the armature 18 also moves an operatively attached needle 22 and ball valve 24 to positions that are either separated from or contiguously engaged with a seat, generally indicated at 26. The needle 22 and ball valve 24 define valve structure of the injector 10. Instead of providing the ball valve 24, it can be appreciated that the valve structure could only comprise the needle 22, with an end of the needle engaging the seat 26.

Figure 2:
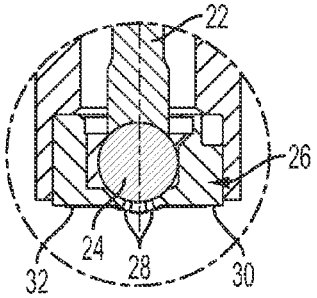
FIG. 2 is an enlarged view of the portion encircled at 2 in FIG. 1.

Movement of the ball valve 24 opens or closes, respectively, the at least one seat passage 28 (FIG. 2) through the seat 24, which permits or inhibits, respectively, fuel from flowing through the fuel outlet 14 of the fuel injector 10. In the embodiment a plurality of seat passages 28 are shown. More or fewer passages 28 can be provided depending on the application. The passages 28 extend through an outer tip surface 30 of the seat 26. The outer tip surface 30 defines an end of the fuel injector 10 and can be considered to be the injector tip face.

It is known through research that at engine operating points where the injector tip face temperatures become high enough, carbon deposits on the injector tip face will oxidize. The temperature at which this occurs varies greatly depending on the measurement method. In centrally injected engines, oxidation occurs at average injector tip face temperatures of greater than 145° C. Clearly instantaneous surface temperatures are likely significantly higher.

In accordance with an embodiment of the invention, to promote the fuel to oxidize preferably before forming hydrocarbon deposits, a catalytic coating 32 is provided on at least a portion of the outer tip surface 30. The coating 32 lowers the oxidation temperature of the fuel and thereby ensures oxidation will occur before hydrocarbon deposits form, or removes, by oxidation, any deposits that may have formed, at a lower temperature than if the coating 32 was not provided. In the embodiment, the coating 32 surrounds, without obstructing, all of the seat passages 28. The coating 32 also ensures that deposits on the outer tip surface 30 that would contribute to particulate emissions are also oxidized.

In the embodiment, the coating 32 on outer tip surface 30 preferably contains cerium oxide or cerium oxide with nano particles of platinum. Other coatings contemplated are those containing vanadium, platinum, or palladium, or any other coating that causes oxidation of fuel on the coating 32 to occur at a temperature lower than if the coating 32 was not present on the surface 30. For example, the coating preferably causes oxidation of fuel or deposits to occur at a temperature less than 145° C.

It can be appreciated that by providing the catalytic coating on the outer tip surface of the injector, oxidation of fuel occurs at a lower temperature to prevent or remove hydrocarbon deposits. Thus, there is less chance of the deposits obstructing the seat passages or causing emission issues.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel injector having an inlet, an outlet, and a passageway providing a fuel flow conduit from the inlet to the outlet, the fuel injector comprising:

a valve structure movable in the passageway between a first position and a second position;

a seat, at the outlet, having at least one seat passage in communication with the passageway, the seat contiguously engaging a portion of the valve structure in the first position thereby closing the at least one seat passage and preventing fuel from exiting the at least one passage, the valve structure in the second position being spaced from the at least one seat passage so that fuel can move through the passageway and exit through the at least one seat passage, the seat including an outer tip surface through which the least one seat passage extends, and a catalytic coating on at least a portion of the outer tip surface, the coating being constructed and arranged to cause oxidation of fuel on the coating to occur at a temperature lower than if the coating was not provided.

2. The fuel injector of claim 1, wherein the coating contains cerium oxide.

3. The fuel injector of claim 1, wherein the coating contains cerium oxide with nano particles of platinum.

4. The fuel injector of claim 1, wherein the coating contains vanadium, platinum, or palladium.

5. The fuel injector of claim 1, wherein the coating is constructed and arranged to cause oxidation of fuel at a temperature less than 145° C.

6. A fuel injector having an inlet, an outlet, and a passageway providing a fuel flow conduit from the inlet to the outlet, the fuel injector comprising:

a valve structure movable in the passageway between a first position and a second position;

a seat, at the outlet, having at least one seat passage in communication with the passageway, the seat contiguously engaging a portion of the valve structure in the first position thereby closing the at least one seat passage and preventing fuel from exiting the at least one passage, the valve structure in the second position being spaced from the at least one seat passage so that fuel can move through the passageway and exit through the at least one seat passage, the seat including an outer tip surface through which the least one seat passage extends, and means for causing oxidation of fuel on the outer tip surface to occur at a temperature lower than if the means for causing oxidation was not provided.

7. The fuel injector of claim 6, wherein the means for causing oxidation is a catalytic coating on at least a portion of the outer tip surface that contains cerium oxide.

8. The fuel injector of claim 6, wherein the means for causing oxidation is a coating on at least a portion of the outer tip surface that contains cerium oxide with nano particles of platinum.

9. The fuel injector of claim 6, wherein the means for causing oxidation is a coating on the outer tip surface that contains vanadium, platinum, or palladium.

10. The fuel injector of claim 6, wherein the coating is constructed and arranged to cause oxidation of fuel at a temperature less than 145° C.

11. A method of promoting oxidation of hydrocarbon deposits that may from on an outer tip surface of a fuel injector, the method comprising:

providing a fuel injector having an inlet; an outlet; a passageway providing a fuel flow conduit from the inlet to the outlet; a valve structure movable in the passageway between a first position and a second position; a seat, at the outlet, having at least one seat passage in communication with the passageway, the seat contiguously engaging a portion of the valve structure in the first position thereby closing the at least one seat passage and preventing fuel from exiting the at least one passage, the valve structure in the second position being spaced from the at least one seat passage so that fuel can move through the passageway and exit through the at least one seat passage, the seat including an outer tip surface through which the least one seat passage extends, and coating a catalyst on at least a portion of the outer tip surface, the catalytic coating being constructed and arranged to cause oxidation of fuel on the coating to occur at a temperature lower than if the coating was not provided.

12. The method of claim 11, wherein the step of coating includes providing the catalytic coating to contain cerium oxide.

13. The method of claim 11, wherein the step of coating includes providing the catalytic coating to contain cerium oxide with nano particles of platinum.

14. The method of claim 11, wherein the step of coating includes providing the catalytic coating to contain vanadium, platinum, or palladium.

15. The method of claim 11, wherein the step of coating includes providing the coating to cause oxidation of fuel at a temperature less than 145° C.

* * * * *